US010753352B2

(12) United States Patent
Ignatiev et al.

(10) Patent No.: US 10,753,352 B2
(45) Date of Patent: Aug. 25, 2020

(54) COMPRESSOR DISCHARGE VALVE ASSEMBLY

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US); Kevin J. Gehret, Fort Loramie, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 360 days.

(21) Appl. No.: 15/831,423

(22) Filed: Dec. 5, 2017

(65) Prior Publication Data

US 2018/0223823 A1 Aug. 9, 2018

Related U.S. Application Data

(60) Provisional application No. 62/455,679, filed on Feb. 7, 2017.

(51) Int. Cl.
*F04C 29/12* (2006.01)
*F04B 39/10* (2006.01)
(Continued)

(52) U.S. Cl.
CPC ..... *F04B 39/1073* (2013.01); *F01C 21/10* (2013.01); *F04C 18/0215* (2013.01);
(Continued)

(58) Field of Classification Search
CPC .. F04B 39/1073; F01C 21/10; F04C 18/0215; F04C 28/24; F04C 29/0021; F04C 29/128; F04C 2240/603
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1137614 A 12/1996
CN 1158944 A 9/1997
(Continued)

OTHER PUBLICATIONS

Office Action regarding Chinese Patent Application No. 201180010366.1, dated Jun. 4, 2014. Translation provided by Unitalen Attorneys at Law.
(Continued)

*Primary Examiner* — Deming Wan
(74) *Attorney, Agent, or Firm* — Harness, Dickey & Pierce, P.L.C.

(57) ABSTRACT

A compressor may include a shell, a non-orbiting scroll, an orbiting scroll, and a discharge valve member. The shell may define a discharge chamber. The non-orbiting scroll may be disposed within the discharge chamber and includes a first end plate and a first spiral wrap extending from the first end plate. The orbiting scroll may be disposed within the discharge chamber and includes a second end plate and a second spiral wrap extending from the second end plate. The first and second spiral wraps mesh with each other to define fluid pockets therebetween. The second end plate includes a discharge passage extending therethrough. The discharge valve member may be attached to the second end plate and may be movable between an open position allowing fluid flow from the discharge passage to the discharge chamber and a closed position restricting fluid flow from the discharge passage to the discharge chamber.

28 Claims, 4 Drawing Sheets

(51) Int. Cl.

| | |
|---|---|
| ***F04C 18/02*** | (2006.01) |
| ***F04C 28/24*** | (2006.01) |
| ***F04C 29/00*** | (2006.01) |
| ***F01C 21/10*** | (2006.01) |
| *F04C 23/00* | (2006.01) |

(52) U.S. Cl.
CPC ..... *F04C 28/24* (2013.01); *F04C 29/0021* (2013.01); *F04C 29/128* (2013.01); *F04C 23/008* (2013.01)

(58) Field of Classification Search
USPC ..... 418/55.1–55.5
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,497,615 A 2/1985 Griffith
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,940,395 A 7/1990 Yamamoto et al.
4,954,057 A 9/1990 Caillat et al.
4,990,071 A 2/1991 Sugimoto
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.

(56) References Cited

U.S. PATENT DOCUMENTS 6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
8,025,492 B2 9/2011 Seibel et al.
8,303,278 B2 11/2012 Roof et al.
8,303,279 B2 11/2012 Hahn
8,308,448 B2 11/2012 Fields et al.
8,328,531 B2 12/2012 Milliff et al.
8,393,882 B2 3/2013 Ignatiev et al.
8,506,271 B2 8/2013 Seibel et al.
8,517,703 B2 8/2013 Doepker
8,585,382 B2 11/2013 Akei et al.
8,616,014 B2 12/2013 Stover et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,127,677 B2 9/2015 Doepker
9,145,891 B2 9/2015 Kim et al.
9,249,802 B2 2/2016 Doepker et al.
9,303,642 B2 4/2016 Akei et al.
9,435,340 B2 9/2016 Doepker et al.
9,494,157 B2 11/2016 Doepker
9,605,677 B2 3/2017 Heidecker et al.
9,624,928 B2 4/2017 Yamazaki et al.
9,651,043 B2 5/2017 Stover et al.
9,777,730 B2 10/2017 Doepker et al.
9,790,940 B2 10/2017 Doepker et al.
9,879,674 B2 1/2018 Akei et al.
9,989,057 B2 6/2018 Lochner et al.
10,066,622 B2 9/2018 Pax et al.
10,087,936 B2 10/2018 Pax et al.
10,094,380 B2 10/2018 Doepker et al.
2001/0010800 A1 8/2001 Kohsokabe et al.
2002/0039540 A1 4/2002 Kuroki et al.
2003/0044296 A1 3/2003 Chen
2003/0044297 A1* 3/2003 Gennami ..... F04C 18/0215 418/55.1
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0036661 A1 2/2007 Stover
2007/0110604 A1 5/2007 Peyton
2007/0130973 A1 6/2007 Lifson et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0305270 A1 12/2008 Uhlianuk et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0135509 A1 6/2011 Fields et al.
2011/0206548 A1 8/2011 Doepker
2011/0243777 A1 10/2011 Ito et al.
2011/0250085 A1 10/2011 Stover et al.
2011/0293456 A1 12/2011 Seibel et al.
2012/0009076 A1 1/2012 Kim et al.
2012/0107163 A1 5/2012 Monnier et al.
2012/0183422 A1 7/2012 Bahmata

(56) References Cited

U.S. PATENT DOCUMENTS

| | | | |
|---|---|---|---|
| 2012/0195781 | A1 | 8/2012 | Stover et al. |
| 2013/0078128 | A1 | 3/2013 | Akei |
| 2013/0089448 | A1 | 4/2013 | Ginies et al. |
| 2013/0094987 | A1 | 4/2013 | Yamashita et al. |
| 2013/0121857 | A1 | 5/2013 | Liang et al. |
| 2013/0302198 | A1 | 11/2013 | Ginies et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2015/0037184 | A1 | 2/2015 | Rood et al. |
| 2015/0086404 | A1 | 3/2015 | Kiem et al. |
| 2015/0192121 | A1 | 7/2015 | Sung et al. |
| 2015/0330386 | A1 | 11/2015 | Doepker |
| 2015/0345493 | A1 | 12/2015 | Lochner et al. |
| 2015/0354719 | A1 | 12/2015 | van Beek et al. |
| 2016/0025093 | A1 | 1/2016 | Doepker |
| 2016/0025094 | A1 | 1/2016 | Ignatiev et al. |
| 2016/0047380 | A1 | 2/2016 | Kim et al. |
| 2016/0053759 | A1 | 2/2016 | Choi et al. |
| 2016/0076543 | A1 | 3/2016 | Akei et al. |
| 2016/0115954 | A1 | 4/2016 | Doepker et al. |
| 2016/0138879 | A1 | 5/2016 | Matsukado et al. |
| 2016/0201673 | A1 | 7/2016 | Perevozchikov et al. |
| 2017/0002817 | A1 | 1/2017 | Stover |
| 2017/0002818 | A1 | 1/2017 | Stover |
| 2017/0030354 | A1 | 2/2017 | Stover |
| 2017/0241417 | A1 | 8/2017 | Jin et al. |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2017/0342978 | A1 | 11/2017 | Doepker |
| 2017/0342983 | A1 | 11/2017 | Jin et al. |
| 2017/0342984 | A1 | 11/2017 | Jin et al. |
| 2018/0023570 | A1 | 1/2018 | Huang et al. |
| 2018/0038369 | A1 | 2/2018 | Doepker et al. |
| 2018/0038370 | A1 | 2/2018 | Doepker et al. |
| 2018/0066656 | A1 | 3/2018 | Perevozchikov et al. |
| 2018/0066657 | A1 | 3/2018 | Perevozchikov et al. |
| 2018/0149155 | A1 | 5/2018 | Akei et al. |
| 2019/0040861 | A1 | 2/2019 | Doepker et al. |
| 2019/0101120 | A1 | 4/2019 | Perevozchikov et al. |
| 2019/0186491 | A1 | 6/2019 | Perevozchikov et al. |
| 2019/0203709 | A1 | 7/2019 | Her et al. |
| 2019/0353164 | A1 | 11/2019 | Berning et al. |

FOREIGN PATENT DOCUMENTS

| | | | |
|---|---|---|---|
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1517553 | A | 8/2004 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 209621603 | U | 11/2019 |
| CN | 209654225 | U | 11/2019 |
| DE | 3917656 | C2 | 11/1995 |
| DE | 102011001394 | A1 | 9/2012 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | 03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H7026618 | B2 | 3/1995 |
| JP | H07293456 | A | 11/1995 |
| JP | H08247053 | A | 9/1996 |
| JP | H8320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |

(56) References Cited

FOREIGN PATENT DOCUMENTS

| | | | |
|---|---|---|---|
| JP | 2013104305 | A | 5/2013 |
| JP | 2013167215 | A | 8/2013 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

Office Action regarding Chinese Patent Application No. 201610516097.0, dated Jun. 27, 2017. Translation provided by Unitalen Attorneys at Law.
Notice of Allowance regarding U.S. Appl. No. 15/186,092, dated Dec. 20, 2018.
Office Action regarding Indian Patent Application No. 1306/MUMNP/2015, dated Dec. 31, 2018.
Notice of Allowance regarding U.S. Appl. No. 15/187,225, dated Jan. 3, 2019.
Office Action regarding Chinese Patent Application No. 201610499158.7, dated Feb. 1, 2019. Translation provided by Unitalen Attorneys at Law.
Notice of Allowance regarding U.S. Appl. No. 15/784,458, dated Feb. 7, 2019.
Notice of Allowance regarding U.S. Appl. No. 15/784,540, dated Feb. 7, 2019.
Search Report regarding European Patent Application No. 18198310.7, dated Feb. 27, 2019.
Notice of Allowance regarding U.S. Appl. No. 15/186,151, dated Mar. 19, 2019.
Notice of Allowance regarding U.S. Appl. No. 15/186,092, dated Apr. 19, 2019.
Office Action regarding Chinese Patent Application No. 201710795228.8, dated Apr. 29, 2019. Translation provided by Unitalen Attorneys at Law.
Notice of Allowance regarding U.S. Appl. No. 15/187,225, dated May 2, 2019.
Office Action regarding U.S. Appl. No. 15/587,735, dated May 17, 2019.
Office Action regarding Chinese Patent Application No. 201811011292.3, dated Jun. 21, 2019. Translation provided by Unitalen Attorneys at Law.
Office Action regarding European Patent Application No. 11747996.4, dated Jun. 26, 2019.
U.S. Appl. No. 16/147,920, filed Oct. 1, 2018, Michael M. Perevozchikov et al.
U.S. Appl. No. 16/154,406, filed Oct. 8, 2018, Roy J. Doepker et al.
U.S. Appl. No. 16/154,844, filed Oct. 9, 2018, Jeffrey Lee Berning et al.
U.S. Appl. No. 16/177,902, filed Nov. 1, 2018, Michael M. Perevozchikov et al.
Luckevich, Mark, "MEMS microvalves: the new valve world." Valve World, May 2007, pp. 79-83.
Extended European Search Report regarding Application No. EP07254962, dated Mar. 12, 2008.
U.S. Office Action regarding U.S. Appl. No. 11/645,288, dated Nov. 30, 2009.
First China Office Action regarding Application No. 200710160038.5, dated Jul. 8, 2010. Translation provided by Unitalen Attorneys At Law.
International Search Report regarding Application No. PCT/US2010/030248, dated Nov. 26, 2010.
Written Opinion of the International Searching Authority regarding Application No. PCT/US2010/030248, dated Nov. 26, 2010.
International Search Report regarding Application No. PCT/US2011/025921, dated Oct. 7, 2011.
Written Opinion of the International Search Authority regarding Application No. PCT/US2011/025921, dated Oct. 7, 2011.
China Office Action regarding Application No. 200710160038.5, dated Jan. 31, 2012. Translation provided by Unitalen Attorneys At Law.
U.S. Office Action regarding U.S. Appl. No. 13/181,065, dated Nov. 9, 2012.
International Search Report regarding Application No. PCT/US2013/051678, dated Oct. 21, 2013.
Written Opinion of the International Searching Authority regarding Application No. PCT/US2013/051678, dated Oct. 21, 2013.
China Office Action regarding Application No. 201080020243.1, dated Nov. 5, 2013. Translation provided by Unitalen Attorneys At Law.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/069462, dated Feb. 21, 2014.
Written Opinion of the International Searching Authority regarding Application No. PCT/US2013/069462, dated Feb. 21, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
Second Office Action regarding China Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Office Action regarding Chinese Patent Application No. 201410461048.2, dated Nov. 30, 2015. Translation provided by Unitalen Attorneys at Law.
Interview Summary regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792.0, dated Feb. 25, 2016. Translation provided by Unitalen Attorneys at Law.
Restriction Requirement regarding U.S. Appl. No. 14/060,102, dated Mar. 16, 2016.

(56) References Cited

OTHER PUBLICATIONS

First Office Action regarding Chinese Application No. 201380059666.8, dated Apr. 5, 2016. Translation provided by Unitalen Attorneys At Law.
First Office Action regarding Chinese Application No. 201380062614.6, dated Apr. 5, 2016. Translation provided by Unitalen Attorneys At Law.
Advisory Action regarding U.S. Appl. No. 14/073,293, dated Apr. 18, 2016.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys At Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471 dated Feb. 23, 2018.
Office Action regarding Indian Patent Application No. 1907/MUMNP/2012, dated Feb. 26, 2018.
Election Requirement regarding U.S. Appl. No. 15/186,092, dated Apr. 3, 2018.
Election Requirement regarding U.S. Appl. No. 15/784,458, dated Apr. 5, 2018.
Office Action regarding Korean Patent Application No. 10-2016-7034539, dated Apr. 11, 2018. Translation provided by Y.S. Chang & Associates.
Office Action regarding U.S. Appl. No. 15/186,151, dated May 3, 2018.
Office Action regarding Chinese Patent Application No. 201610930347.5, dated May 14, 2018. Translation provided by Unitalen Attorneys at Law.
Election/Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Election/Restriction Requirement regarding U.S. Appl. No. 15/587,735, dated Jul. 23, 2018.
Office Action regarding Chinese Patent Application No. 201610499158.7, dated Aug. 1, 2018. Translation provided by Unitalen Attorneys at Law.
Applicant-Initiated Interview Summary regarding U.S. Appl. No. 15/186,092, dated Aug. 14, 2018.
Office Action regarding U.S. Appl. No. 15/187,225, dated Aug. 27, 2018.
Office Action regarding Chinese Patent Application No. 201710795228.8, dated Sep. 5, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding Indian Patent Application No. 1307/MUMNP/2015, dated Sep. 12, 2018.
Office Action regarding Chinese Patent Application No. 201580029636.1, dated Oct. 8, 2018. Translation provided by Unitalen Attorneys at Law.
Office Action regarding U.S. Appl. No. 15/587,735, dated Oct. 9, 2018.
Office Action regarding U.S. Appl. No. 15/186,151, dated Nov. 1, 2018.

(56) References Cited

OTHER PUBLICATIONS

Office Action regarding Korean Patent Application No. 10-2017-7033995, dated Nov. 29, 2018. Translation provided by KS KORYO International IP Law Firm.
Office Action regarding Chinese Patent Application No. 201580041209.5, dated Jan. 17, 2018. Translation provided by Unitalen Attorneys at Law.
Notice of Allowance regarding U.S. Appl. No. 15/186,151, dated Jul. 25, 2019.
Office Action regarding Chinese Patent Application No. 201610499158.7, dated Aug. 1, 2019. Translation provided by Unitalen Attorneys at Law.
Office Action regarding Chinese Patent Application No. 201811168307.7, dated Aug. 12, 2019. Translation provided by Unitalen Attorneys at Law.
Restriction Requirement regarding U.S. Appl. No. 15/682,599, dated Aug. 14, 2019.
Notice of Allowance regarding U.S. Appl. No. 15/587,735, dated Aug. 23, 2019.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Chinese Patent Application No. 201780055443.2, dated Sep. 2, 2019. Translation provided by Unitalen Attorneys at Law.
Office Action regarding U.S. Appl. No. 15/692,844, dated Sep. 20, 2019.
U.S. Appl. No. 15/682,599, Perevozchikov et al.
U.S. Appl. No. 15/692,844, Perevozchikov et al.
Non-Final Office Action for U.S. Appl. No. 11/522,250, dated Aug. 1, 2007.
Notification of the First Office Action received from the Chinese Patent Office dated Mar. 6, 2009 regarding Application No. 200710153687.2, translated by CCPIT Patent and Trademark Law Office.
Non-Final Office Action for U.S. Appl. No. 12/103,265, dated May 27, 2009.
Non-Final Office Action for U.S. Appl. No. 12/103,265, dated Dec. 17, 2009.
Notice of Grounds for Rejection regarding Korean Patent Application No. 10-2007-0093478 dated Feb. 25, 2010. Translation provided by Y.S. Chang & Associates.
Final Office Action for U.S. Appl. No. 12/103,265, dated Jun. 15, 2010.
Final Preliminary Notice of Grounds for Rejection regarding Korean Patent Application No. 10-2007-0093478, dated Aug. 31, 2010. Translation provided by Y.S. Chang & Associates.
Advisory Action for U.S. Appl. No. 12/103,265, dated Sep. 17, 2010.
First Office Action regarding Chinese Patent Application No. 201010224582.3, dated Apr. 17, 2012. English translation provided by Unitalen Attorneys at Law.
First Examination Report regarding India-Patent Application No. 1071/KOL/2007, dated Apr. 27, 2012.
Non-Final Office Action for U.S. Appl. No. 13/0365,529, dated Aug. 22, 2012.
International Search Report regarding International Application No. PCT/US2015/042479, dated Oct. 23, 2015.
Written Opinion of the International Searching Authority regarding International Application No. PCT/US2015/042479, dated Oct. 23, 2015.
Restriction Requirement regarding U.S. Appl. No. 14/809,786, dated Aug. 16, 2017.
International Search Report regarding International Application No. PCT/US2017/050525, dated Dec. 28, 2017.
Written Opinion of the International Searching Authority regarding International Application No. PCT/US2017/050525, dated Dec. 28, 2017.
U.S. Appl. No. 14/809,786, filed Jul. 27, 2015, Kirill M. Ignatiev et al.
U.S. Appl. No. 15/682,599, filed Aug. 22, 2017, Michael M. Perevozchikov et al.
U.S. Appl. No. 15/692,844, filed Aug. 31, 2017, Michael M. Perevozchikov et al.
Office Action regarding Chinese Patent Application No. 201710795228.8, dated Oct. 28, 2019. Translation provided by Unitalen Attorneys at Law.
Office Action regarding European Patent Application No. 11747996.4, dated Nov. 5, 2019.
Notice of Allowance regarding U.S. Appl. No. 15/186,151, dated Nov. 14, 2019.
Office Action regarding Indian Patent Application No. 2043/MUMNP/2011, dated Nov. 27, 2019.
Office Action regarding Chinese Patent Application No. 201811480347.5, dated Jan. 10, 2020. Translation provided by Unitalen Attorneys at Law.
Office Action regarding Chinese Patent Application No. 201811541653.5, dated Jan. 10, 2020. Translation provided by Unitalen Attorneys at Law.
Office Action regarding European Patent Application No. 11747996.4, dated Jan. 14, 2020.
Office Action regarding U.S. Appl. No. 15/881,016, dated Jan. 23, 2020.
Office Action regarding U.S. Appl. No. 15/682,599, dated Jan. 24, 2020.
Notice of Allowance regarding U.S. Appl. No. 15/692,844, dated Feb. 20, 2020.
Office Action regarding European Patent Application No. 13859308.2, dated Mar. 4, 2020.
Office Action regarding Chinese Patent Application No. 201811168307.7, dated Mar. 27, 2020. Translation provided by Unitalen Attorneys at Law.
Non-Final Office Action for U.S. Appl. No. 14/809,786, dated Jan. 11, 2018.

* cited by examiner

COMPRESSOR DISCHARGE VALVE ASSEMBLY

CROSS-REFERENCE TO RELATED APPLICATIONS

This application claims the benefit of U.S. Provisional Application No. 62/455,679, filed on Feb. 7, 2017. The entire disclosure of the above application is incorporated herein by reference.

FIELD

The present disclosure relates to a compressor, and particularly, to a discharge valve assembly for a compressor.

BACKGROUND

This section provides background information related to the present disclosure and is not necessarily prior art.

Compressors are used in a variety of industrial, commercial and residential applications to circulate a working fluid within a climate-control system (e.g., a refrigeration system, an air conditioning system, a heat-pump system, a chiller system, etc.) to provide a desired cooling and/or heating effect. A typical climate-control system may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor that may include a shell, a non-orbiting scroll, an orbiting scroll, a driveshaft, a discharge valve member, and a valve backer. The shell may define a discharge chamber. The non-orbiting scroll may be disposed within the discharge chamber and includes a first end plate and a first spiral wrap extending from the first end plate. The orbiting scroll may be disposed within the discharge chamber and includes a second end plate and a second spiral wrap extending from the second end plate. The first and second spiral wraps mesh with each other to define a plurality of fluid pockets therebetween. The second end plate includes a discharge passage extending therethrough. The driveshaft drives the orbiting scroll and rotates relative to the orbiting scroll. The discharge valve member may be attached to the second end plate and movable between an open position allowing fluid flow from the discharge passage to the discharge chamber and a closed position restricting fluid flow from the discharge passage to the discharge chamber. The valve backer may be disposed on an end of the driveshaft and may be rotatable with the driveshaft relative to the orbiting scroll and the discharge valve member. The valve backer may force the discharge valve member into the closed position during a first portion of a rotation of the driveshaft and may allow the discharge valve member to move into the open position during a second portion of the rotation of the driveshaft.

In some configurations, the valve backer includes an axial end surface having a tip portion and a recessed portion. The tip portion is disposed closer to the second end plate than the recessed portion.

In some configurations, the discharge valve member includes a fixed portion and a movable portion. The movable portion may be deflectable relative to the fixed portion between the open and closed positions.

In some configurations, the tip portion of the valve backer contacts the movable portion and retains the movable portion in contact with a valve seat during the first portion of the rotation of the driveshaft. The recessed portion may be axially aligned with the movable portion during the second portion of the rotation of the driveshaft.

In some configurations, the valve backer includes a recess that at least partially receives an eccentric crank pin of the driveshaft.

In some configurations, the compressor includes a spring disposed within the recess and contacting the valve backer and an axial end of the eccentric crank pin.

In some configurations, the valve backer and the eccentric crank pin are disposed within an annular hub of the orbiting scroll. The annular hub extends from the second end plate in a direction opposite the second spiral wrap.

The fluid pockets defined by the first and second spiral wraps move from a radially outermost position, to a radially intermediate position, to a radially innermost position. In some configurations, the discharge passage receives fluid from the fluid pocket at the radially innermost position.

In some configurations, the valve backer is rotationally fixed relative to the driveshaft.

In some configurations, the valve backer and the driveshaft are separate and discrete components that are attached to each other. In other configurations, the valve backer could be integrally formed with the driveshaft.

The present disclosure also provides a compressor that may include a non-orbiting scroll, an orbiting scroll, a driveshaft, a discharge valve member, and a valve backer. The non-orbiting scroll includes a first end plate and a first spiral wrap extending from the first end plate. The orbiting scroll includes a second end plate and a second spiral wrap extending from the second end plate. The first and second spiral wraps mesh with each other to define a plurality of fluid pockets therebetween. The second end plate includes a discharge passage extending therethrough. The driveshaft drives the orbiting scroll and rotates relative to the orbiting scroll. The discharge valve member may be movable between an open position allowing fluid flow through the discharge passage and a closed position restricting fluid flow through the discharge passage. The valve backer may be movable relative to the discharge valve member and the second end plate to force the discharge valve member into the closed position during a first portion of a rotation of the driveshaft and allow the discharge valve member to move into the open position during a second portion of the rotation of the driveshaft.

In some configurations, the valve backer is rotationally fixed relative to the driveshaft.

In some configurations, the valve backer includes an axial end surface having a tip portion and a recessed portion. The tip portion is disposed closer to the second end plate than the recessed portion.

In some configurations, the discharge valve member includes a fixed portion and a movable portion. The movable portion may be deflectable relative to the fixed portion between the open and closed positions.

In some configurations, the tip portion of the valve backer contacts the movable portion and retains the movable portion in contact with a valve seat during the first portion of the rotation of the driveshaft. The recessed portion may be axially aligned with the movable portion during the second portion of the rotation of the driveshaft.

In some configurations, the valve backer includes a recess that at least partially receives an eccentric crank pin of the driveshaft.

In some configurations, the compressor includes a spring disposed within the recess and contacting the valve backer and an axial end of the eccentric crank pin.

In some configurations, the valve backer and the eccentric crank pin are disposed within an annular hub of the orbiting scroll. The annular hub extends from the second end plate in a direction opposite the second spiral wrap.

The fluid pockets defined by the first and second spiral wraps move from a radially outermost position, to a radially intermediate position, to a radially innermost position. In some configurations, the discharge passage receives fluid from a fluid pocket at the radially innermost position.

In some configurations, the valve backer and the driveshaft are separate and discrete components that are attached to each other. In other configurations, the valve backer could be integrally formed with the driveshaft.

The present disclosure also provides a compressor that may include a non-orbiting scroll, an orbiting scroll, a driveshaft, and a discharge valve member. The non-orbiting scroll includes a first end plate and a first spiral wrap extending from the first end plate. The orbiting scroll includes a second end plate and a second spiral wrap extending from the second end plate. The first and second spiral wraps mesh with each other to define a plurality of fluid pockets therebetween. The second end plate includes a discharge passage that is open to one of the fluid pockets and extends through the second end plate. The driveshaft drives the orbiting scroll. The discharge valve member may be movable between an open position allowing fluid flow from the discharge passage to a discharge chamber and a closed position restricting fluid flow from the discharge passage to the discharge chamber. The discharge valve member may move into the open position in response to a pressure differential between the one of the fluid pockets and the discharge chamber rising above a predetermined value. Movement of the discharge valve member into the closed position may be based on a rotational position of the driveshaft and is independent of the pressure differential between the one of the fluid pockets and the discharge chamber.

In some configurations, the compressor includes a valve backer rotationally fixed relative to the driveshaft and movable relative to the discharge valve member and the second end plate to force the discharge valve member into the closed position during a first portion of a rotation of the driveshaft and allow the discharge valve member to move into the open position during a second portion of the rotation of the driveshaft.

In some configurations, the valve backer includes an axial end surface having a tip portion and a recessed portion.

In some configurations, the tip portion is disposed closer to the second end plate than the recessed portion.

In some configurations, the discharge valve member includes a fixed portion and a movable portion.

In some configurations, the movable portion is deflectable relative to the fixed portion between the open and closed positions.

In some configurations, the tip portion of the valve backer contacts the movable portion and retains the movable portion in contact with a valve seat during the first portion of the rotation of the driveshaft. The recessed portion may be axially aligned with the movable portion during the second portion of the rotation of the driveshaft.

In some configurations, the valve backer and the driveshaft are separate and discrete components that are attached to each other. In other configurations, the valve backer could be integrally formed with the driveshaft.

The fluid pockets defined by the first and second spiral wraps move from a radially outermost position, to a radially intermediate position, to a radially innermost position. In some configurations, the discharge passage receives fluid from the fluid pocket at the radially innermost position.

The present disclosure also provides a compressor that may include a shell, a non-orbiting scroll, an orbiting scroll, and a discharge valve member. The shell may define a discharge chamber. The non-orbiting scroll may be disposed within the discharge chamber and includes a first end plate and a first spiral wrap extending from the first end plate. The orbiting scroll may be disposed within the discharge chamber and includes a second end plate and a second spiral wrap extending from the second end plate. The first and second spiral wraps mesh with each other to define a plurality of fluid pockets therebetween. The second end plate includes a discharge passage extending therethrough. The discharge valve member may be attached to the second end plate and may be movable between an open position allowing fluid flow from the discharge passage to the discharge chamber and a closed position restricting fluid flow from the discharge passage to the discharge chamber.

In some configurations, the discharge valve member moves into the open position in response to a pressure differential between the one of the fluid pockets and the discharge chamber rising above a predetermined value. Movement of the discharge valve member into the closed position may be based on a rotational position of a driveshaft (e.g., a driveshaft driving the orbiting scroll) and may be independent of the pressure differential between the one of the fluid pockets and the discharge chamber.

In some configurations, the compressor includes a valve backer rotationally fixed relative to the driveshaft and movable relative to the discharge valve member and the second end plate to force the discharge valve member into the closed position during a first portion of a rotation of the driveshaft and allow the discharge valve member to move into the open position during a second portion of the rotation of the driveshaft.

In some configurations, the valve backer includes an axial end surface having a tip portion and a recessed portion.

In some configurations, the tip portion is disposed closer to the second end plate than the recessed portion.

In some configurations, the discharge valve member includes a fixed portion and a movable portion.

In some configurations, the movable portion is deflectable relative to the fixed portion between the open and closed positions.

In some configurations, the tip portion of the valve backer contacts the movable portion and retains the movable portion in contact with a valve seat during the first portion of the rotation of the driveshaft.

In some configurations, the recessed portion is axially aligned with the movable portion during the second portion of the rotation of the driveshaft.

The fluid pockets defined by the first and second spiral wraps move from a radially outermost position, to a radially intermediate position, to a radially innermost position. In some configurations, the discharge passage receives fluid from the fluid pocket at the radially innermost position.

In some configurations, the compressor includes a driveshaft driving the orbiting scroll and rotating relative to the orbiting scroll. The discharge valve member may contact the driveshaft in the open position.

In some configurations, the discharge valve member includes a fixed portion and a movable portion. The movable portion is deflectable relative to the fixed portion between the open and closed positions. The movable portion contacts the driveshaft in the open position.

In some configurations, the movable portion contacts an axial end of the driveshaft in the open position.

In some configurations, the movable portion contacts an axial end of an eccentric crank pin of the driveshaft in the open position.

In some configurations, a surface that rotates relative to the orbiting scroll during operation of the compressor contacts the discharge valve member at least intermittently. In some configurations, the surface is an axial end surface of a crank pin of a driveshaft that drives the orbiting scroll. In some configurations, the surface is an axial end surface of a valve backer attached to an end of a driveshaft that drives the orbiting scroll.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
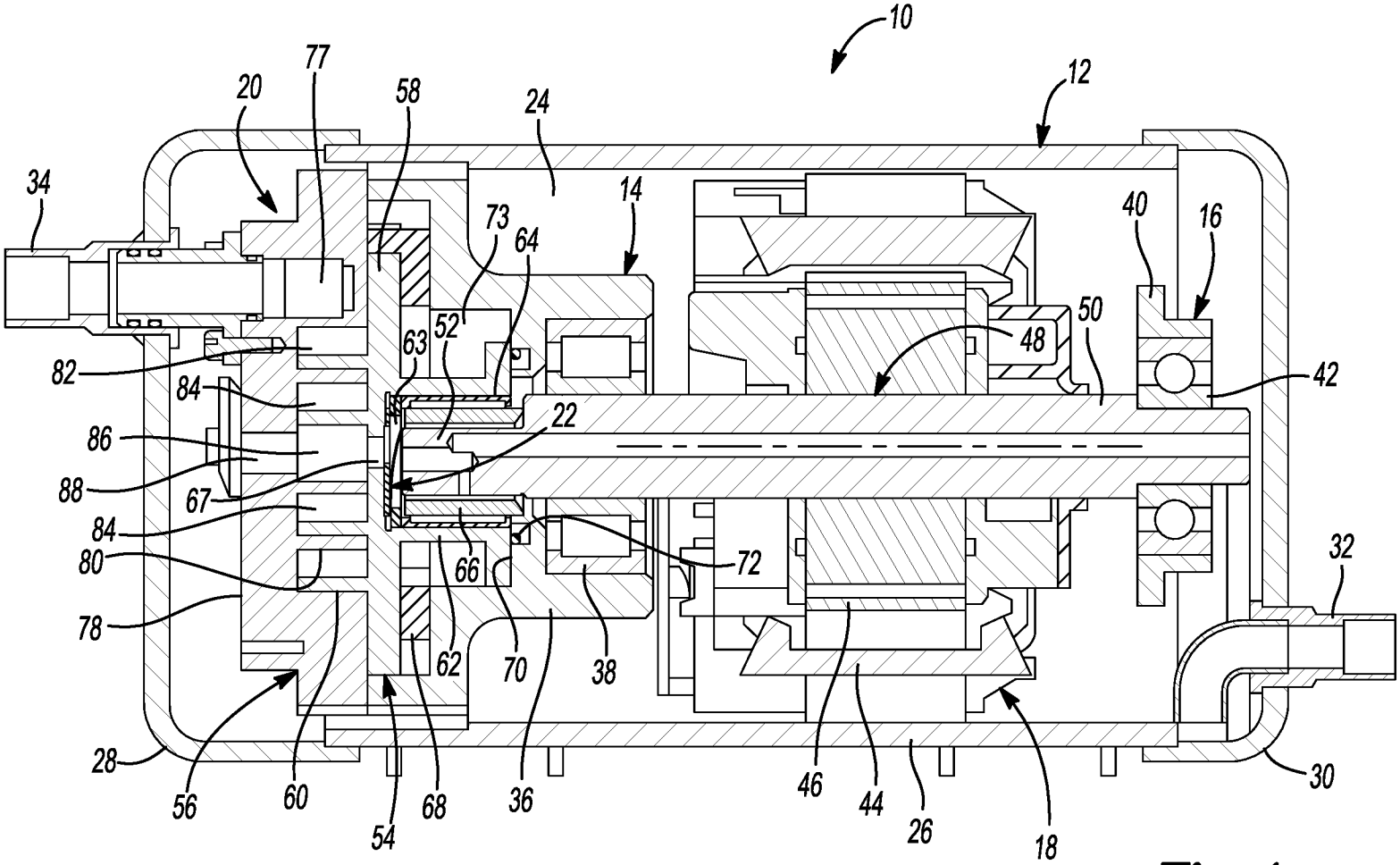
FIG. 1 is a cross-sectional view of a compressor having a discharge valve assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided. As shown in FIG. 1, the compressor 10 may be a high-side scroll compressor including a hermetic shell assembly 12, a first and second bearing assemblies 14, 16, a motor assembly 18, a compression mechanism 20, and a discharge valve assembly 22.

The shell assembly 12 may define a high-pressure discharge chamber 24 (containing compressed working fluid) and may include a cylindrical shell 26, a first end cap 28 at one end thereof, and a base or second end cap 30 at another end thereof. A discharge fitting 32 may be attached to the shell assembly 12 and extend through a first opening in the shell assembly 12 to allow working fluid in the discharge chamber 24 to exit the compressor 10. For example, the discharge fitting 32 may extend through the second end cap 30, as shown in FIG. 1. An inlet fitting 34 may be attached to the shell assembly 12 (e.g., at the first end cap 28) and extend through a second opening in the shell assembly 12. The inlet fitting 34 may extend through a portion of the discharge chamber 24 and is fluidly coupled to a suction inlet of the compression mechanism 20. In this manner, the inlet fitting 34 provides low-pressure (suction-pressure) working fluid to the compression mechanism 20 while fluidly isolating the suction-pressure working fluid within the inlet fitting 34 from the high-pressure (e.g., discharge-pressure) working fluid in the discharge chamber 24.

The first and second bearing assemblies 14, 16 may be disposed entirely within the discharge chamber 24. The first bearing assembly 14 may include a first bearing housing 36 and a first bearing 38. The first bearing housing 36 may be fixed to the shell assembly 12. The first bearing housing 36 houses the first bearing 38 and axially supports the compression mechanism 20. The second bearing assembly 16 may include a second bearing housing 40 and a second bearing 42. The second bearing housing 40 is fixed to the shell assembly 12 and supports the second bearing 42.

The motor assembly 18 may be disposed entirely within the discharge chamber 24 and may include a motor stator 44, a rotor 46, and a driveshaft 48. The stator 44 may be fixedly attached (e.g., by press fit) to the shell 26. The rotor 46 may be press fit on the driveshaft 48 and may transmit rotational power to the driveshaft 48. The driveshaft 48 may include a main body 50 and an eccentric crank pin 52 extending from an axial end of the main body 50. The main body 50 is received in the first and second bearings 38, 42 and is rotatably supported by the first and second bearing assemblies 14, 16. Therefore, the first and second bearings 38, 42 define a rotational axis of the driveshaft 48. The crank pin 52 may engage the compression mechanism 20.

The compression mechanism 20 may be disposed entirely within the discharge chamber 24 and may include an orbiting scroll 54 and a non-orbiting scroll 56. The orbiting scroll 54 may include an end plate 58 having a spiral wrap 60 extending from a first side of the end plate 58. An annular hub 62 may extend from a second side of the end plate 58 and may include a cavity 63 in which a drive bearing 64, a drive bushing 66 and the crank pin 52 may be disposed. The drive bushing 66 may be received within the drive bearing 64. The crank pin 52 may be received within the drive bushing 66.

The end plate 58 of the orbiting scroll 54 may also include a discharge passage 67 that may be open to and disposed directly adjacent to the cavity 63. The discharge passage 67 is in communication with the discharge chamber 24 via the cavity 63. The cavity 63 is in communication with the discharge chamber 24 via gaps between the hub 62 and the drive bearing 64, between the drive bearing 64 and drive bushing 66, and/or between the drive bushing 66 and the crank pin 52. In some configurations, cavity 63 is in communication with the discharge chamber 24 via flow passages formed in any one or more of the hub 62, drive bearing 64, or drive bushing 66, for example.

An Oldham coupling 68 may be engaged with the end plate 58 and either the non-orbiting scroll 56 or the first bearing housing 36 to prevent relative rotation between the orbiting and non-orbiting scrolls 54, 56. The annular hub 62 may be axially supported by a thrust surface 70 of the first bearing housing 36. The annular hub 62 may movably engage a seal 72 attached to the first bearing housing 36 to define an intermediate-pressure cavity 73 between the first bearing housing 36 and the orbiting scroll 54.

The non-orbiting scroll 56 may include an end plate 78 and a spiral wrap 80 projecting from the end plate 78. The spiral wrap 80 may meshingly engage the spiral wrap 60 of the orbiting scroll 54, thereby creating a series of moving fluid pockets therebetween. The fluid pockets defined by the spiral wraps 60, 80 may decrease in volume as they move from a radially outer position 82 to a radially intermediate position 84 to a radially innermost position 86 throughout a compression cycle of the compression mechanism 20. The inlet fitting 34 is fluidly coupled with a suction inlet 77 in the end plate 78 and provides suction-pressure working fluid to the fluid pockets at the radially outer positions 82.

In some configurations, the end plate 78 of the non-orbiting scroll 56 may include a discharge passage 88. The discharge passage 67 in the orbiting scroll 54 and the discharge passage 88 in the non-orbiting scroll 56 may be in communication with the fluid pocket at the radially innermost position 86. The discharge passages 67, 88 are in communication with the discharge chamber 24 and provide compressed working fluid to the discharge chamber 24. In some configurations, the non-orbiting scroll 56 does not have the discharge passage 88. In such configurations, the end plate 58 of the orbiting scroll 54 may include multiple discharge passages 67.

Figure 2:
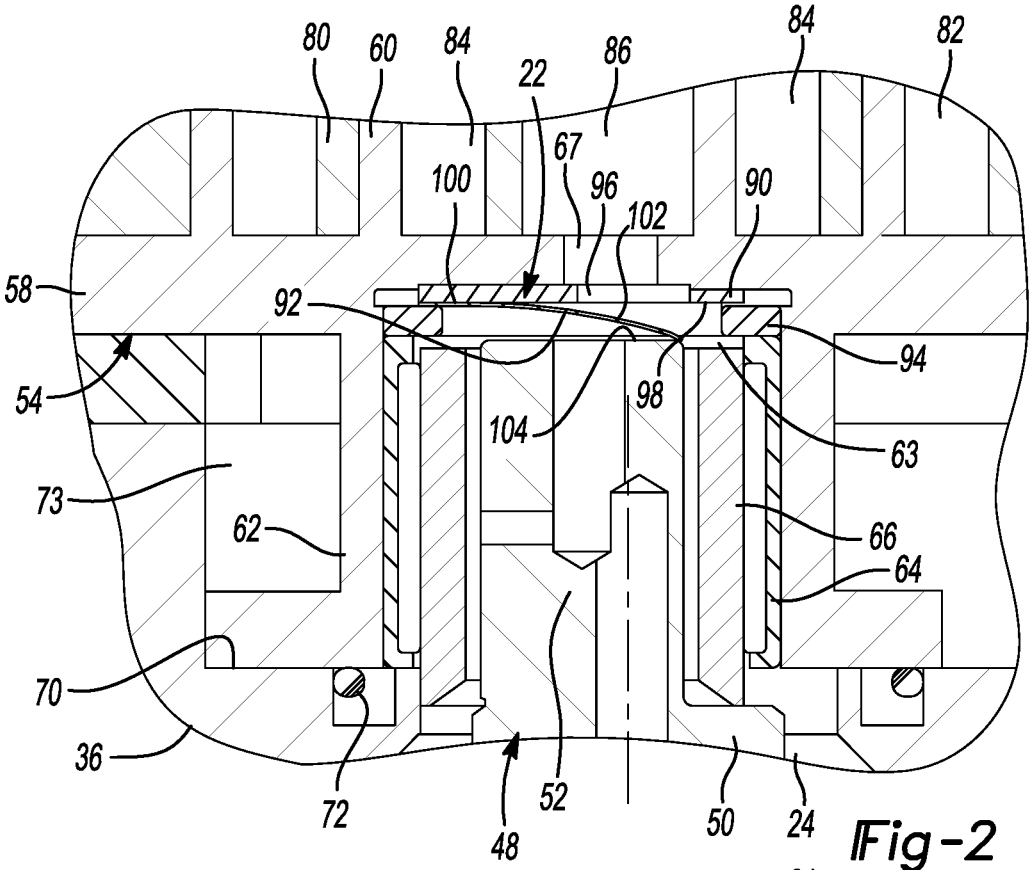
FIG. 2 is a partial cross-sectional view of the compressor of FIG. 1 with a discharge valve member of the discharge valve assembly in an open position.
Figure 3:
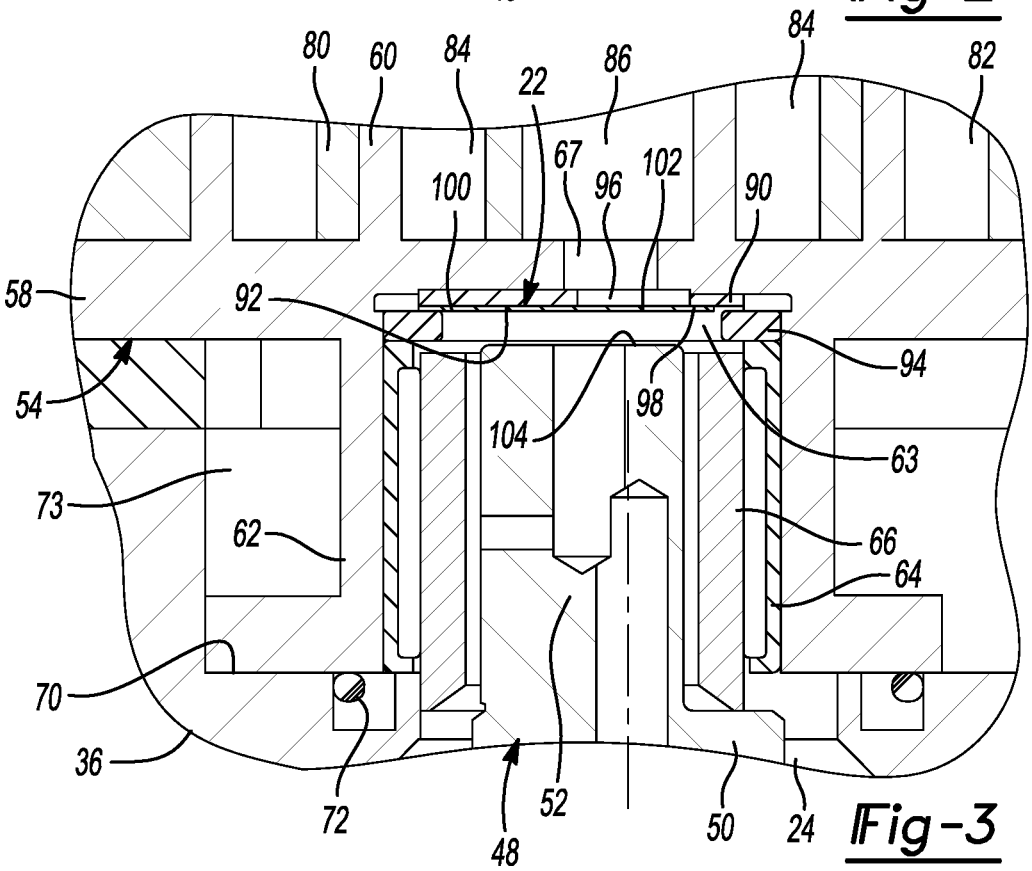
FIG. 3 is a partial cross-sectional view of the compressor of FIG. 1 with the discharge valve member in a closed position.

As shown in FIGS. 2 and 3, the discharge valve assembly 22 may be received within the cavity 63 and may be mounted to the end plate 58. The discharge valve assembly 22 controls fluid flow between the discharge chamber 24 and the discharge passage 67. The discharge valve assembly 22 may include a valve seat member 90, a discharge valve member 92, and a retainer ring 94. The valve seat member 90 can be a generally disk-shaped member, for example, and may be fixed to the end plate 58. The valve seat member 90 may include an opening 96 in communication with the discharge passage 67 and the cavity 63. The valve seat member 90 may define a valve seat 98 against which the discharge valve member 92 can selectively seat to restrict fluid flow through the discharge passage 67. In some configurations, the discharge valve member 92 may seat against a valve seat defined by the end plate 58 (i.e., the discharge valve member 92 may seat directly against the end plate 58 to restrict fluid flow through the discharge passage 67).

The discharge valve member 92 may be a reed valve, for example, and may be a relatively thin and resiliently flexible body having a fixed portion 100 and a movable portion 102. The fixed portion 100 may be fixed relative to the valve seat member 90 and the end plate 58. The movable portion 102 may resiliently deflect relative to the fixed portion 100, the valve seat member 90 and the end plate 58 between an open position (FIG. 2) and a closed position (FIG. 3). In the open position, the movable portion 102 of the discharge valve member 92 may be spaced apart from the valve seat 98 to allow fluid flow through the discharge passage 67 (i.e., to allow fluid from the radially innermost fluid pocket 86 to flow through the discharge passage 67 and into the discharge chamber 24). In the closed position, the movable portion 102 of the discharge valve member 92 contacts the valve seat 98 to restrict or prevent fluid flow through the discharge passage 67 (e.g., to restrict or prevent fluid flow from the discharge passage 67 to the radially innermost fluid pocket 86).

While the discharge valve member 92 is described above as being a reed valve, in some configurations, the discharge valve member 92 could be another type of valve, such as a linearly movable disk, puck or ball, for example.

The retainer ring 94 may be an annular disk-shaped member and may be fixed to the hub 62 and/or the end plate 58. The retainer ring 94 may contact the valve seat member 90 and/or the fixed portion 100 of the discharge valve member 92 to axially retain the valve seat member 90 and the discharge valve member 92 relative to the end plate 58.

During operation of the compressor 10, fluid pressure within the radially innermost fluid pocket 86 may control movement of the discharge valve member 92 between the open and closed positions. That is, when a pressure differential between the radially innermost fluid pocket 86 and the discharge chamber 24 reaches or rises above a predetermined value, the fluid pressure within the radially innermost fluid pocket 86 may deflect the movable portion 102 of the discharge valve member 92 into the open position. When the pressure differential between the radially innermost fluid pocket 86 and the discharge chamber 24 falls below the predetermined value, the movable portion 102 of the discharge valve member 92 may spring back to the closed position.

As shown in FIG. 2, the movable portion 102 may contact an axial end 104 and/or a chamfered edge of the axial end 104 of the eccentric crank pin 52 of the driveshaft 48. In this manner, the axial end 104 of the crank pin 52 limits the range of movement of the movable portion 102 of the discharge valve member 92 away from the valve seat 98. Limiting the range of movement of the movable portion 102 away from the valve seat 98 reduces the closing time of the discharge valve member 92 and reduces noise associate with the closing of the discharge valve member 92. Furthermore, since the discharge valve member 92 contacts the axial end 104 of the crank pin 52 in the open position, the discharge valve assembly 22 does not need to have a separate valve backer to limit the range of the motion of the discharge valve member 92. In this manner, the axial height of the hub 62 (i.e., the height along the axis of rotational symmetry of the hub 62) of the orbiting scroll 54 can be reduced since the cavity 63 does not have to be sized to accommodate a valve backer between the axial end 104 of the driveshaft 48 and the end plate 58. Such reduced axial height reduces the overall size of the compressor 10 and also reduces a tipping moment of the orbiting scroll 54. That is, a tendency of the orbiting scroll 54 to tip or tilt relative to the first bearing housing 36, the driveshaft 48 and the non-orbiting scroll 56 while the orbiting scroll 54 orbits is reduced. Reducing the tipping moment of the orbiting scroll 54 may reduce wear on the orbiting and non-orbiting scrolls 54, 56 and/or the first bearing housing 36. Reducing the tipping moment of the orbiting scroll 54 may also improve sealing between the orbiting and non-orbiting scrolls 54, 56 and between the orbiting scroll 54 and the first bearing housing 36.

Figure 4:
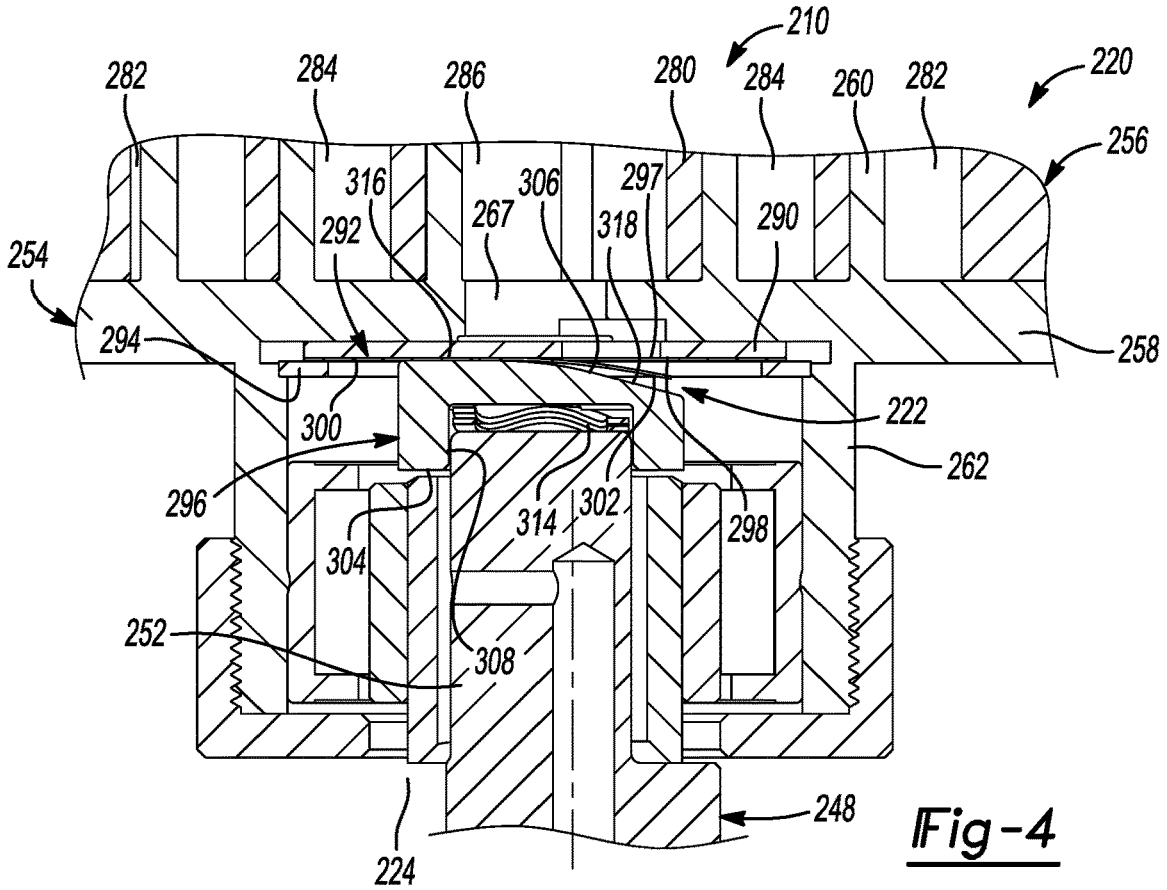
FIG. 4 is a partial cross-sectional view of another compressor having discharge valve assembly with a discharge valve member in an open position.
Figure 5:
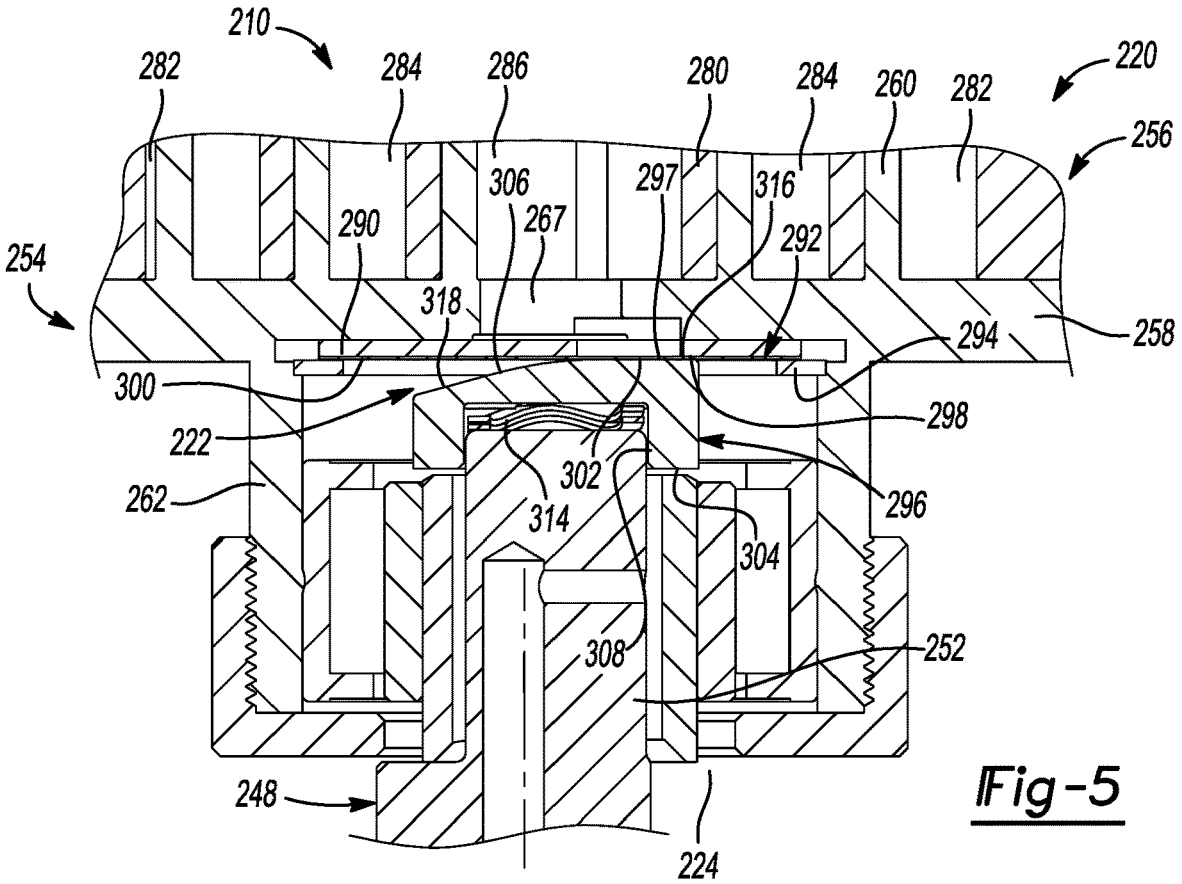
FIG. 5 is a partial cross-sectional view of the compressor and discharge valve assembly of FIG. 4 with the discharge valve member in a closed position.
Figure 6:
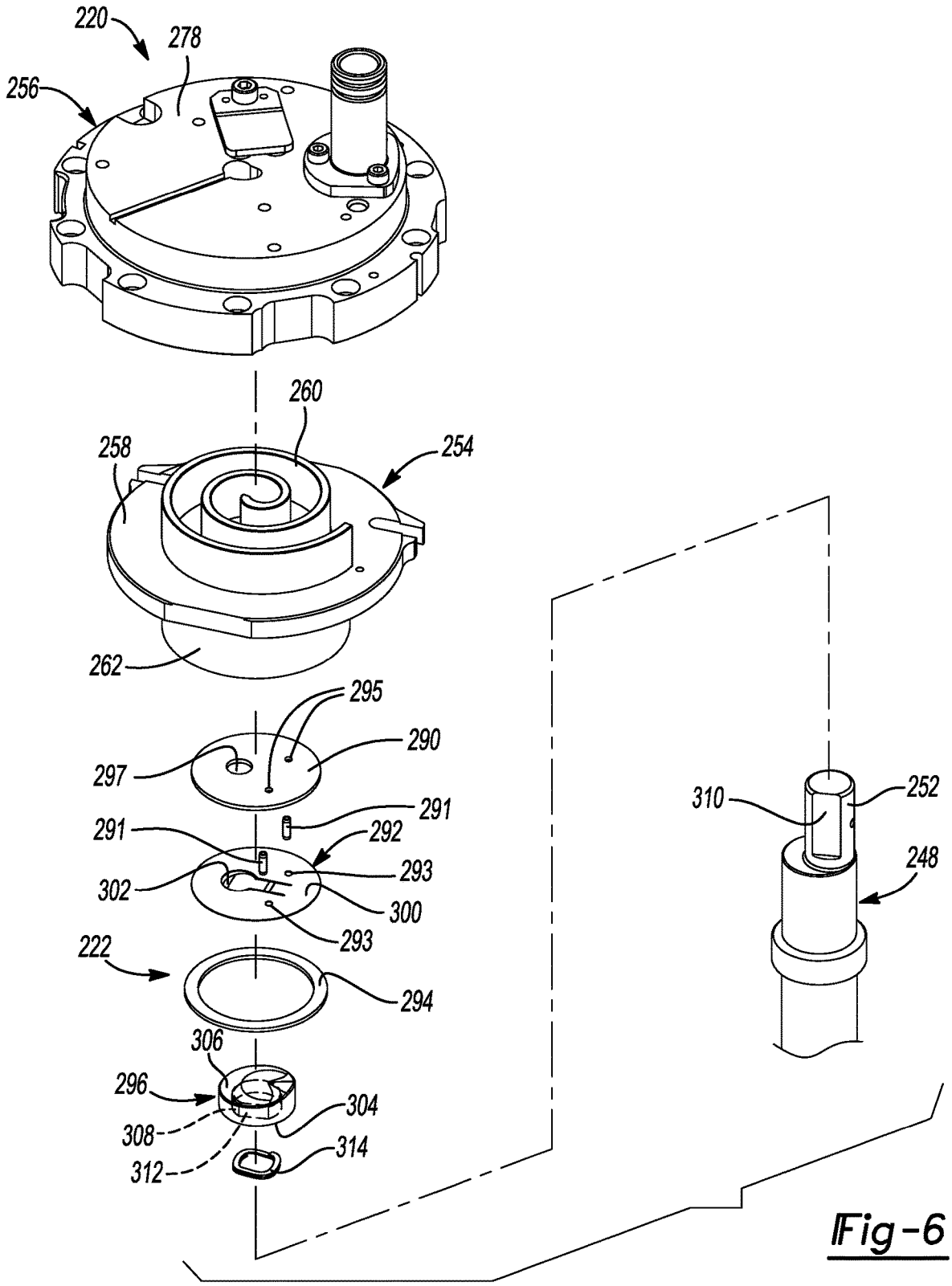
FIG. 6 is an exploded view of an orbiting scroll, the discharge valve assembly and driveshaft of the compressor of FIG. 4.

With reference to FIG. 4-6, another compressor 210 (only partially shown in FIGS. 4-6) is provided. The compressor 210 may include a shell assembly (not shown), first and second bearing assemblies (not shown), a motor assembly (of which, only a driveshaft 248 is shown), a compression mechanism 220, and a discharge valve assembly 222. The structure and function of the shell assembly, bearing assemblies, motor assembly and compression mechanism 220 of the compressor 210 may be similar or identical to that of the shell assembly 12, bearing assemblies 14, 16, motor assembly 18 and compression mechanism 20 described above. Therefore, similar features might not be described again in detail.

Briefly, the compression mechanism 220 includes an orbiting scroll 254 and a non-orbiting scroll 256. Like the orbiting scroll 54, the orbiting scroll 254 includes an end plate 258, a spiral wrap 260 extending from one side of the end plate 258, and an annular hub 262 extending from the opposite side of the end plate 258. A discharge passage 267 extends through the end plate 258. Like the non-orbiting scroll 56, the non-orbiting scroll 256 includes an end plate 278 (FIG. 6) and a spiral wrap 280 (FIGS. 4 and 5) extending from the end plate 278. The spiral wrap 280 of the non-orbiting scroll 256 meshes with the spiral wrap 260 of the orbiting scroll to define fluid pockets that move from a radially outer position 282 to a radially intermediate position 284 to a radially innermost position 286 throughout a compression cycle of the compression mechanism 220. The discharge passage 267 is in communication with the fluid pocket at the radially innermost position 286. As will be described in more detail below, the discharge valve assembly 222 controls fluid flow between the discharge passage 267 and a discharge chamber 224 (similar or identical to discharge chamber 24 described above).

The discharge valve assembly 222 may include a valve seat member 290, a discharge valve member 292, a retainer ring 294, and a valve backer 296. The valve seat member 290 may be a disk-shaped member having an opening 297 in communication with the discharge passage 267 and the discharge chamber 224 (via cavity 263 defined by the hub 262). The valve seat member 290 may be fixedly attached to the end plate 258 of the orbiting scroll 254. The valve seat member 290 may define a valve seat 298 (FIGS. 4 and 5) against which the discharge valve member 292 can selectively seat to restrict fluid flow through the discharge passage 267. In some configurations, the discharge valve member 292 may seat against a valve seat defined by the end plate 258 (i.e., the discharge valve member 292 may seat directly against the end plate 258 to restrict fluid flow through the discharge passage 267).

The discharge valve member 292 may be a reed valve, for example, and may be a relatively thin and resiliently flexible body having a fixed portion 300 and a movable portion 302. The fixed portion 300 may be fixed relative to the valve seat member 290 and the end plate 258. The movable portion 302 may resiliently deflect relative to the fixed portion 300, the valve seat member 290 and the end plate 258 between an open position (FIG. 4) and a closed position (FIG. 5). In the open position, the movable portion 302 of the discharge valve member 292 may be spaced apart from the valve seat 298 to allow fluid flow through the discharge passage 267 (i.e., to allow fluid from the radially innermost fluid pocket 286 to flow through the discharge passage 267 and into the discharge chamber 224). In the closed position, the movable portion 302 of the discharge valve member 292 contacts the valve seat 298 to restrict or prevent fluid flow through the discharge passage 267 (e.g., to restrict or prevent fluid flow from the discharge passage 267 to the radially innermost fluid pocket 286).

While the discharge valve member 292 is described above as being a reed valve, in some configurations, the discharge valve member 292 could be another type of valve, such as a linearly movable disk, puck or ball, for example.

The retainer ring 294 may be an annular disk-shaped member and may be fixed to the hub 262 and/or the end plate 258. The retainer ring 294 may contact the valve seat member 290 and/or the fixed portion 300 of the discharge valve member 292 to axially retain the valve seat member 290 and the discharge valve member 292 relative to the end plate 258.

Pins 291 (FIG. 6) may extend through apertures 293 (FIG. 6) in the fixed portion 300 of the discharge valve member 292, through apertures 295 (FIG. 6) in valve seat member 290, and through apertures (not shown) in the end plate 258. In this manner, the pins 291 rotationally fix the valve seat member 290 and the discharge valve member 292 relative to the end plate 258.

The valve backer 296 may be a generally cylindrical member having a first axial end 304 and a second axial end 306. The first axial end 304 may include a recess 308 in which an eccentric crank pin 252 of the driveshaft 248 is received. The crank pin 252 may include a flat surface 310 (FIG. 6) that engages a corresponding flat surface 312 (FIG. 6) defining the recess 308. Engagement between the flat surfaces 310, 312 rotationally fixes the valve backer 296 to the driveshaft 248 while allowing relative axial movement (i.e., movement in a direction along or parallel to the rotational axis of the driveshaft 248) between the valve backer 296 and the driveshaft 248. One or more springs 314 (e.g., resiliently compressible wave rings) may be disposed within the recess 308 and may contact the valve backer 296 and an axial end of the crank pin 252 to bias the valve backer 296 and the driveshaft 248 in axially opposite directions (e.g., to axially bias the valve backer 296 into contact with the discharge valve member 292).

As shown in FIGS. 4 and 5, the second axial end 306 of the valve backer 296 may include a tip portion 316 and a sloped recessed portion 318. The tip portion 316 may contact the discharge valve member 292. The recessed portion 318 may be axially spaced apart from the fixed portion 300 of discharge valve member 292 and may be axially spaced apart from the movable portion 302 of the discharge valve member 292 at least while the movable portion 302 is in the closed position. In some configurations, the movable portion 302 may contact the recessed portion 318 when the movable portion 302 is in the open position. The recessed portion 318 may be sloped (e.g., angled and/or curved) such that the recessed portion 318 extends axially toward the first axial end 304 of the valve backer 296 as the recessed portion 318 extends radially away from the tip portion 316. In other words, the tip portion 316 is disposed axially closer (i.e., closer in a direction along or parallel to the rotational axis of the driveshaft 248) to the end plate 258 than the recessed portion 318, and the recessed portion 318 slopes away from the end plate 258.

While the valve backer 296 and driveshaft 248 are described above and shown in the figures as being separate and discrete components, in some configurations, the valve backer 296 and driveshaft 248 could be integrally formed. That is, the axial end of the crank pin 252 can be shaped to a tip portion and a recessed portion similar to that of the separate and distinct valve backer 296 described above.

During operation of the compressor 210, the driveshaft 248 and the valve backer 296 rotate together relative to the orbiting scroll 254. During a first portion of each 360-degree-rotation of the driveshaft 248 and valve backer 296, the tip portion 316 of the valve backer 296 is radially spaced apart (i.e., spaced apart in a direction perpendicular to the rotational axis of the driveshaft 248) from the opening 297 in the valve seat member 290 and the movable portion 302 of the discharge valve member 292, and the recessed portion 318 of the valve backer 296 is generally aligned with the opening 297 in the valve seat member 290 and the movable portion 302 of the discharge valve member 292, as shown in FIG. 4. Therefore, during the first portion of the each 360-degree-rotation of the driveshaft 248 and valve backer 296, the recessed portion 318 of the valve backer 296 provides clearance for the movable portion 302 to move from the closed position to the open position, as shown in FIG. 4. The movable portion 302 will move toward the open position during the first portion of the each 360-degree-rotation of the driveshaft 248 and valve backer 296 and when a pressure differential between the radially innermost fluid pocket 286 and the discharge chamber 224 reaches or exceeds a predetermined value (i.e., when the fluid pressure within the radially innermost fluid pocket 286 sufficiently exceeds the fluid pressure within the discharge chamber 224).

During a second portion of each 360-degree-rotation of the driveshaft 248 and valve backer 296, the tip portion 316 of the valve backer 296 is in contact with the movable portion 302 of the discharge valve member 292, which forces the movable portion 302 into the closed position and restricts or prevents the movable portion 302 from moving toward the open position, as shown in FIG. 5. In this manner, the valve backer 296 forces the movable portion 302 of the discharge valve member 292 into the closed position regardless of the pressure differential between the radially innermost fluid pocket 286 and the discharge chamber 224. In other words, the valve backer 296 forces the movable portion 302 to remain in the closed position during the second portion of each 360-degree-rotation of the driveshaft 248 and valve backer 296 even if the fluid pressure within the radially innermost fluid pocket 286 exceeds the fluid pressure within the discharge chamber 224.

Closing the discharge valve member 292 using the valve backer 296 in the manner described above reduces noise during operation of the compressor 210 and improves the efficiency of the compressor 210. That is, closing the discharge valve member 292 using the valve backer 296 may reduce the closing velocity of the movable portion 302 of the discharge valve member 292, which reduces the noise generated when the movable portion 302 impacts the valve seat 298. Furthermore, closing the discharge valve member 292 using the valve backer 296 may reduce a delay associated with valve closing. That is, the tip portion 316 and recessed portion 318 of the valve backer 296 can be shaped and positioned such that the discharge valve member 292 is closed at an more optimal time, which can reduce backflow through the discharge passage 267 (i.e., reduce flow of working fluid from the discharge chamber 224 to the radially innermost fluid pocket 286). Reducing backflow improves the efficiency of the compressor 210.

The valve backer 296 allows the opening of the discharge valve member 292 to vary depending on operating conditions (i.e., operating pressure ratio) of the compressor 210 and the climate-control system in which the compressor 210 is installed. However, the closing of the discharge valve member 292 with the valve backer 296 is defined by the geometry of the valve backer 296 and the rotational position of the driveshaft 248, and therefore, is independent of operating conditions of the compressor 210 and the climate-control system in which the compressor 210 is installed. The geometry of the valve backer 296 (i.e., the positioning and shapes of the tip portion 316 and recessed portion 318) can be tailored based on scroll geometry to prevent backflow and to suit a given application.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a non-orbiting scroll including a first end plate and a first spiral wrap extending from the first end plate;

an orbiting scroll including a second end plate and a second spiral wrap extending from the second end plate, the first and second spiral wraps meshing with each other to define a plurality of fluid pockets therebetween, the second end plate including a discharge passage extending therethrough;

a driveshaft driving the orbiting scroll;

a discharge valve member movable between an open position allowing fluid flow through the discharge passage and a closed position restricting fluid flow through the discharge passage; and a valve backer movable relative to the discharge valve member and the second end plate to force the discharge valve member into the closed position during a first portion of a rotation of the driveshaft and allow the discharge valve member to move into the open position during a second portion of the rotation of the driveshaft.

2. The compressor of claim 1, wherein the valve backer is rotationally fixed relative to the driveshaft.

3. The compressor of claim 1, wherein the valve backer includes an axial end surface having a tip portion and a recessed portion, and wherein the tip portion is disposed closer to the second end plate than the recessed portion.

4. The compressor of claim 3, wherein the discharge valve member includes a fixed portion and a movable portion, and wherein the movable portion is deflectable relative to the fixed portion between the open and closed positions.

5. The compressor of claim 4, wherein the tip portion of the valve backer contacts the movable portion of the discharge valve member and retains the movable portion of the discharge valve member in contact with a valve seat during the first portion of the rotation of the driveshaft, and wherein the recessed portion is axially aligned with the movable portion of the discharge valve member during the second portion of the rotation of the driveshaft.

6. The compressor of claim 1, wherein the valve backer includes a recess that at least partially receives an eccentric crank pin of the driveshaft.

7. The compressor of claim 6, further comprising a spring disposed within the recess and contacting the valve backer and an axial end of the eccentric crank pin.

8. The compressor of claim 7, wherein the valve backer and the eccentric crank pin are disposed within an annular hub of the orbiting scroll, and wherein the annular hub extends from the second end plate in a direction opposite the second spiral wrap.

9. The compressor of claim 1, wherein the fluid pockets defined by the first and second spiral wraps move from a radially outermost position, to a radially intermediate position, to a radially innermost position, and wherein the discharge passage receives fluid from a fluid pocket at the radially innermost position.

10. The compressor of claim 1, wherein the valve backer and the driveshaft are separate and discrete components that are attached to each other.

11. A compressor comprising:

a non-orbiting scroll including a first end plate and a first spiral wrap extending from the first end plate;

an orbiting scroll including a second end plate and a second spiral wrap extending from the second end plate, the first and second spiral wraps meshing with each other to define a plurality of fluid pockets therebetween, the second end plate including a discharge passage that is open to one of the fluid pockets and extends through the second end plate;

a driveshaft driving the orbiting scroll; and a discharge valve member movable between an open position allowing fluid flow from the discharge passage to a discharge chamber and a closed position restricting the fluid flow from the discharge passage to the discharge chamber, wherein the discharge valve member moves into the open position in response to a pressure differential between the one of the fluid pockets and the discharge chamber rising above a predetermined value, and wherein movement of the discharge valve member into the closed position is based on a rotational position of the driveshaft and is independent of the pressure differential between the one of the fluid pockets and the discharge chamber.

12. The compressor of claim 11, further comprising a valve backer rotationally fixed relative to the driveshaft and movable relative to the discharge valve member and the second end plate to force the discharge valve member into the closed position during a first portion of a rotation of the driveshaft and allow the discharge valve member to move into the open position during a second portion of the rotation of the driveshaft.

13. The compressor of claim 12, wherein:

the valve backer includes an axial end surface having a tip portion and a recessed portion, the tip portion is disposed closer to the second end plate than the recessed portion, the discharge valve member includes a fixed portion and a movable portion, and the movable portion is deflectable relative to the fixed portion between the open and closed positions.

14. The compressor of claim 13, wherein the tip portion of the valve backer contacts the movable portion and retains the movable portion in contact with a valve seat during the first portion of the rotation of the driveshaft, and wherein the recessed portion is axially aligned with the movable portion during the second portion of the rotation of the driveshaft.

15. The compressor of claim 14, wherein the valve backer and the driveshaft are separate and discrete components that are attached to each other.

16. The compressor of claim 11, wherein the fluid pockets defined by the first and second spiral wraps move from a radially outermost position, to a radially intermediate position, to a radially innermost position, and wherein the discharge passage receives fluid from a fluid pocket at the radially innermost position.

17. A compressor comprising:

a shell defining a discharge chamber;

a non-orbiting scroll disposed within the discharge chamber and including a first end plate and a first spiral wrap extending from the first end plate;

an orbiting scroll disposed within the discharge chamber and including a second end plate and a second spiral wrap extending from the second end plate, the first and second spiral wraps meshing with each other to define a plurality of fluid pockets therebetween, the second end plate including a discharge passage extending therethrough;

a discharge valve member attached to the second end plate and movable between an open position allowing fluid flow from the discharge passage to the discharge chamber and a closed position restricting fluid flow from the discharge passage to the discharge chamber; and a driveshaft driving the orbiting scroll and rotating relative to the orbiting scroll, wherein the discharge valve member contacts the driveshaft in the open position.

18. The compressor of claim 17, wherein the fluid pockets defined by the first and second spiral wraps move from a radially outermost position, to a radially intermediate position, to a radially innermost position, and wherein the discharge passage receives fluid from the fluid pocket at the radially innermost position.

19. The compressor of claim 17, wherein the discharge valve member includes a fixed portion and a movable portion, wherein the movable portion is deflectable relative to the fixed portion between the open and closed positions, and wherein the movable portion contacts the driveshaft in the open position.

20. The compressor of claim 19, wherein the movable portion contacts an axial end of the driveshaft in the open position.

21. The compressor of claim 19, wherein the movable portion contacts an axial end of an eccentric crank pin of the driveshaft in the open position.

22. A compressor comprising:

a shell defining a discharge chamber;

a non-orbiting scroll disposed within the discharge chamber and including a first end plate and a first spiral wrap extending from the first end plate;

an orbiting scroll disposed within the discharge chamber and including a second end plate and a second spiral wrap extending from the second end plate, the first and second spiral wraps meshing with each other to define a plurality of fluid pockets therebetween, the second end plate including a discharge passage extending therethrough; and a discharge valve member attached to the second end plate and movable between an open position allowing fluid flow from the discharge passage to the discharge chamber and a closed position restricting fluid flow from the discharge passage to the discharge chamber, wherein a surface that rotates relative to the orbiting scroll during operation of the compressor contacts the discharge valve member at least intermittently.

23. The compressor of claim 22, wherein the surface is an axial end surface of a crank pin of a driveshaft that drives the orbiting scroll.

24. The compressor of claim 23, wherein movement of the discharge valve member into the closed position is based on a rotational position of the driveshaft and is independent of a pressure differential between the one of the fluid pockets and the discharge chamber.

25. The compressor of claim 22, wherein the surface is an axial end surface of a valve backer attached to an end of a driveshaft that drives the orbiting scroll.

26. The compressor of claim 25, wherein movement of the discharge valve member into the closed position is based on a rotational position of the driveshaft and is independent of a pressure differential between the one of the fluid pockets and the discharge chamber.

27. The compressor of claim 25, wherein the valve backer is rotationally fixed relative to the driveshaft and movable relative to the discharge valve member and the second end plate to force the discharge valve member into the closed position during a first portion of a rotation of the driveshaft and allow the discharge valve member to move into the open position during a second portion of the rotation of the driveshaft.

28. The compressor of claim 27, wherein:

the valve backer includes an axial end surface having a tip portion and a recessed portion, the tip portion is disposed closer to the second end plate than the recessed portion, the discharge valve member includes a fixed portion and a movable portion, the movable portion is deflectable relative to the fixed portion between the open and closed positions, the tip portion of the valve backer contacts the movable portion and retains the movable portion in contact with a valve seat during the first portion of the rotation of the driveshaft, and the recessed portion is axially aligned with the movable portion during the second portion of the rotation of the driveshaft.

* * * * *